US012054324B2

(12) United States Patent
Peterson et al.

(10) Patent No.: US 12,054,324 B2
(45) Date of Patent: Aug. 6, 2024

(54) CHILD RESISTANT PACKAGING

(71) Applicant: Hub Folding Box Company, Inc., Mansfield, MA (US)

(72) Inventors: Zane Peterson, Blackstone, MA (US); David Kamyk, Worcester, MA (US)

(73) Assignee: Hub Folding Box Company, Inc., Mansfield, MA (US)

( * ) Notice: Subject to any disclaimer, the term of this patent is extended or adjusted under 35 U.S.C. 154(b) by 608 days.

(21) Appl. No.: 17/314,592

(22) Filed: May 7, 2021

(65) Prior Publication Data

US 2021/0347539 A1 Nov. 11, 2021

Related U.S. Application Data

(60) Provisional application No. 63/021,450, filed on May 7, 2020.

(51) Int. Cl.

| | |
|---|---|
| ***B65D 50/04*** | (2006.01) |
| ***B65D 5/02*** | (2006.01) |
| ***B65D 5/56*** | (2006.01) |

(52) U.S. Cl.

CPC ..... *B65D 50/046* (2013.01); *B65D 5/0227* (2013.01); *B65D 5/563* (2013.01)

(58) Field of Classification Search

CPC ..... B65D 50/046; B65D 5/0227; B65D 5/563

See application file for complete search history.

(56) References Cited

U.S. PATENT DOCUMENTS 174,332 A * 2/1876 White ..... B65D 5/0227 229/152
729,461 A * 5/1903 Webb ..... B65D 5/0227 229/142

(Continued)

FOREIGN PATENT DOCUMENTS

DE 102010014429 A1 * 10/2011 ..... B65D 5/0227
DE 202014001622 U1 * 5/2014 ..... B65D 5/6608

(Continued)

OTHER PUBLICATIONS

PCT International Preliminary Report on Patentability in International Appln. No. PCT/US2021/031332, dated Nov. 17, 2022, 9 pages.

(Continued)

*Primary Examiner* — J. Gregory Pickett
*Assistant Examiner* — Abigail Elizabeth Guidry
(74) *Attorney, Agent, or Firm* — Fish & Richardson P.C.

(57) ABSTRACT

A container that is configured to have an open state and a closed state, in which the container includes an outer cell having a plurality of side panels including a first side panel and a second side panel. The outer cell defines a chamber having a first opening. An inner locking member is attached to an inner wall of the first side panel. An extension panel is coupled to the second side panel. The extension panel includes a first cover panel and a tuck flap, in which the tuck flap includes an extension member and a tuck flap locking member. In the closed state of the container, the first cover panel covers the first opening, and the extension member and the tuck flap locking member are tucked inside the chamber. A bias member biases the tuck flap locking member toward a first position to cause the tuck flap locking member to engage the inner locking member.

22 Claims, 10 Drawing Sheets

(56) References Cited

U.S. PATENT DOCUMENTS

| | | | | | |
|---|---|---|---|---|---|
| 2,072,256 | A | | 3/1937 | Greve | |
| 2,491,278 | A | * | 12/1949 | Ringler | B65D 5/0227 229/160 |
| 3,198,416 | A | | 8/1965 | Hickin et al. | |
| 4,175,675 | A | * | 11/1979 | Maisonneuve | B65D 77/02 426/115 |
| 4,830,270 | A | * | 5/1989 | Holmes | B65D 5/0254 229/102 |
| 5,065,937 | A | * | 11/1991 | Ritter | B65D 5/0227 229/131.1 |
| 5,275,291 | A | * | 1/1994 | Sledge | B65D 83/04 220/348 |
| 5,350,108 | A | | 9/1994 | Friar et al. | |
| 6,047,829 | A | | 4/2000 | Johnstone et al. | |
| 6,079,563 | A | * | 6/2000 | Katchmazenski | B65D 5/5021 206/583 |
| 6,641,031 | B2 | | 11/2003 | Evans et al. | |
| 7,637,375 | B2 | * | 12/2009 | Sattel | B65D 83/0463 229/125.125 |
| 7,819,250 | B2 | | 10/2010 | Sattel et al. | |
| 8,342,330 | B2 | * | 1/2013 | Weston | B65D 77/0413 206/534 |
| 9,926,125 | B2 | | 3/2018 | Whitehurst | |
| 10,479,581 | B2 | | 11/2019 | Chambers et al. | |
| 10,640,257 | B1 | * | 5/2020 | Kraus | B65B 23/22 |
| 11,111,052 | B2 | * | 9/2021 | Hengami | B65D 5/0227 |
| 11,319,108 | B2 | * | 5/2022 | Gauvin | B65D 5/38 |
| 11,345,506 | B2 | * | 5/2022 | Dixon | B65D 5/10 |
| 11,396,411 | B2 | * | 7/2022 | Britton | B65D 55/02 |
| 2005/0173505 | A1 | | 8/2005 | Howell et al. | |
| 2008/0156686 | A1 | * | 7/2008 | Hluchan | B65D 5/38 206/528 |
| 2009/0184023 | A1 | * | 7/2009 | Brollier | B65D 83/0463 206/469 |
| 2010/0116693 | A1 | * | 5/2010 | Hession | B65D 83/0463 206/784 |
| 2013/0075462 | A1 | * | 3/2013 | Jones | B65D 5/4225 229/131.1 |
| 2014/0138262 | A1 | * | 5/2014 | Rajter, Jr. | B65D 5/0209 206/1.5 |
| 2018/0022498 | A1 | * | 1/2018 | Everett | B65D 5/2057 220/682 |
| 2018/0244425 | A1 | * | 8/2018 | Bressan | B65D 5/38 |
| 2019/0315513 | A1 | * | 10/2019 | Hengami | B65D 85/60 |
| 2019/0329930 | A1 | | 10/2019 | Davis | |
| 2020/0180808 | A1 | * | 6/2020 | Gauvin | B65D 5/38 |
| 2020/0180828 | A1 | * | 6/2020 | Cho | B65D 50/046 |
| 2020/0331667 | A1 | * | 10/2020 | Bressan | B65D 50/045 |
| 2021/0347539 | A1 | | 11/2021 | Peterson | |
| 2022/0061599 | A1 | * | 3/2022 | Blair | B65D 83/0894 |
| 2022/0081174 | A1 | * | 3/2022 | Culligan | B65D 50/04 |

FOREIGN PATENT DOCUMENTS

| | | | | | |
|---|---|---|---|---|---|
| DE | 202018005911 | U1 | * | 9/2019 | B65D 5/103 |
| EP | 1044885 | A1 | * | 10/2000 | B65D 5/0227 |
| WO | WO-9408855 | A1 | * | 4/1994 | B65D 5/6608 |
| WO | WO 2018/222531 | | | 12/2018 | |

OTHER PUBLICATIONS

PCT International Search Report and Written Opinion in International Appln. No. PCT/US2021/031332, dated Aug. 9, 2021, 11 pages.

* cited by examiner

CHILD RESISTANT PACKAGING

CROSS-REFERENCE TO RELATED APPLICATION

This application claims priority to U.S. provisional application 63/021,450, filed on May 7, 2020, the entire content of which is incorporated by reference.

TECHNICAL FIELD

This disclosure relates to child resistant packaging.

BACKGROUND

Child resistant ("CR"), senior friendly packaging has been used to safely store potentially hazardous materials, such as pharmaceuticals, for families with young children. In some examples, child resistant packages can be expensive to manufacture, complicated to produce, not senior friendly, or ineffective after multiple uses. In some examples, the child resistant packages include plastic material that may be difficult to recycle.

SUMMARY

In a general aspect, an apparatus includes a container that is configured to have an open state and a closed state, in which the container includes an outer cell, an inner locking member, an extension panel, and a bias member. The outer cell includes a plurality of side panels including a first side panel and a second side panel, in which the second side panel is spaced apart from the first side panel, and the outer cell defines a chamber having a first opening. The inner locking member is attached to an inner wall of the first side panel. The extension panel is coupled to the second side panel, in which the extension panel includes a first cover panel and a tuck flap, and the tuck flap includes an extension member and a tuck flap locking member. In the closed state of the container, the first cover panel is configured to cover the first opening, and the extension member and the tuck flap locking member are tucked inside the chamber. The bias member is configured to bias the tuck flap locking member toward a first position to cause the tuck flap locking member to engage the inner locking member.

Implementations of the aspect can include one or more of the following features. The container can include a release member configured to, upon receiving an external force, bias the tuck flap locking member to a second position to cause the tuck flap locking member to disengage from the inner locking member.

The release member can be formed by a predefined cut, crease, embossed area or graphically identified area.

The outer cell can include a rectangular or square cross sectional shape, the outer cell can include a third side panel and a fourth side panel, the first and second side panels can be parallel to each other, and the third and fourth side panels can be parallel to each other.

The container can include an inner cell, the bias member can be part of the inner cell, the inner cell can include a fifth panel and a sixth panel, the fifth panel can be attached to an inner side of the third side panel, and the sixth panel can be attached to an inner side of the fourth side panel.

The outer cell and the inner cell can be made of a continuous sheet of material.

The fourth side panel can be connected to a first side of the first side panel, a second side of the first side panel can be connected to a first side of the third side panel, a second side of the third side panel can be connected to a first side of the second side panel, a second side of the second side panel can be connected to a first side of the sixth panel, a second side of the sixth panel can be connected to a first side of the bias member, and a second side of the bias member can be connected to the fifth panel.

The inner locking member and the first side panel can be made of a continuous sheet of material, and the extension panel and the second side panel can be made of a continuous sheet of material.

The bias member can include a panel that divides the chamber into a first sub-chamber and a second sub-chamber, the first sub-chamber can be configured to receive an object to be stored in the container, the second sub-chamber can be configured to receive the extension member and the tuck flap locking member when the container is in the closed state.

The first side panel can be parallel to the second side panel, and the bias member can include a bias panel that is parallel to the first and second side panels.

The bias panel can be spaced apart from the first side panel at a first distance, the bias panel can be spaced apart from the second side panel at a second distance, and the second distance can be at least twice the first distance.

The inner locking member can include an inner locking tab that is coupled to the first side panel, folded inward into the chamber, and attached to the inner wall of the first side panel. The bias panel can be spaced apart from the inner locking tab at a distance that is larger than combined thicknesses of the extension member and the tuck flap locking member.

The first cover panel, the extension member, and the tuck flap locking member can be formed by an outer triple fold.

The container can include an inner sleeve, the bias member can be part of the inner sleeve, and the outer sleeve and the inner sleeve can be formed using a continuous sheet of material.

The container can include a second cover panel that is coupled to the inner sleeve, and both the first cover panel and the second cover panel can cover the first opening when the container is in the closed state.

In another general aspect, an apparatus includes a container, in which the container includes side panels, an extension panel, a bias member, and an inner locking member. The side panels define a chamber having an opening. The extension panel includes a first cover panel and a tuck flap, in which the tuck flap includes an extension member and a tuck flap locking member. The first cover panel, the extension member, and the tuck flap locking member are formed by an outer triple fold. In a closed state of the container, the first cover panel is configured to cover the first opening, and the extension member and the tuck flap locking member are tucked inside the chamber. The bias member is configured to bias the tuck flap locking member toward a first position when the container is in the closed state. The inner locking member is positioned inside the chamber and configured to engage the tuck flap locking member when the tuck flap locking member is in the first position.

Implementations of the above aspects can include one or more of the following features. The container can include a release member configured to, upon receiving an external force, bias the tuck flap locking member to a second position to cause the tuck flap locking member to disengage from the inner locking member.

In another general aspect, an apparatus includes a container, in which the container includes an outer cell, an inner cell, an inner locking member, and an extension panel. The outer cell includes a first side panel, a second side panel, a third side panel, and a fourth side panel, in which the first side panel is connected to a first side of the second side panel, a second side of the second side panel is connected to a first side of the third side panel, a second side of the third side panel is connected to a first side of the fourth side panel, wherein the outer cell defines a chamber having a first opening. The inner cell includes a fifth panel, a sixth panel, and a seventh panel, in which a second side of the fourth side panel is connected to a first side of the fifth panel, a second side of the fifth panel is connected to a first side of the sixth panel, a second side of the sixth panel is connected to a first side of the seventh panel. The fifth panel is attached to an inner side of the first side panel, the seventh panel is attached to an inner side of the third side panel, and the sixth panel is spaced apart from the second side panel and the fourth side panel. The fourth side panel, the fifth panel, the sixth panel, and the seventh panel define a first chamber, and the second side panel and the sixth panel define a second chamber. The inner locking member is disposed in the second chamber. The extension panel is coupled to the fourth side panel, in which the extension panel includes a first cover panel and a tuck flap, and the tuck flap includes an extension member and a tuck flap locking member. In a closed state of the container, the first cover panel is configured to cover the first opening, the extension member and the tuck flap locking member are tucked inside the second chamber, and the sixth panel is configured to bias the tuck flap locking member to a first position to engage the inner locking member.

Implementations of the above aspects can include one or more of the following features. The container can include a release member configured to, upon receiving an external force, bias the tuck flap locking member to a second position to cause the tuck flap locking member to disengage from the inner locking member.

In another general aspect, an apparatus includes a container having a cover panel and a tuck flap formed by an outer triple fold, in which in a closed state of the container, the cover panel is configured to cover an opening of the container, and the tuck flap is configured to be inserted into a chamber of the container and engage an inner locking member.

Implementations of the above aspects can include one or more of the following features.

The apparatus can include a release member configured to, upon receiving an external force, bias the tuck flap to disengage from the inner locking member.

The container can include a folded board.

The container can include a folded paperboard or cardboard.

The container can include a lining on the paperboard to form a moisture or oil barrier and enhance the tear-resistant properties of the paperboard.

The lining can include at least one of polyresin or bioresin.

The details of one or more embodiments of the subject matter described in this specification are set forth in the accompanying drawings and the description below. Other features, aspects, and advantages of the invention will become apparent from the description, the drawings, and the claims.

DETAILED DESCRIPTION

This description relates in general to a recyclable child resistant package or carton, which can be made of, e.g., paperboard. In some implementations, a recyclable child resistant package includes an outer sleeve that defines a partial enclosure having an opening, a cover mechanism for covering the opening, and a locking mechanism for locking the cover mechanism in a manner that is child resistant and senior friendly.

Figure 1:
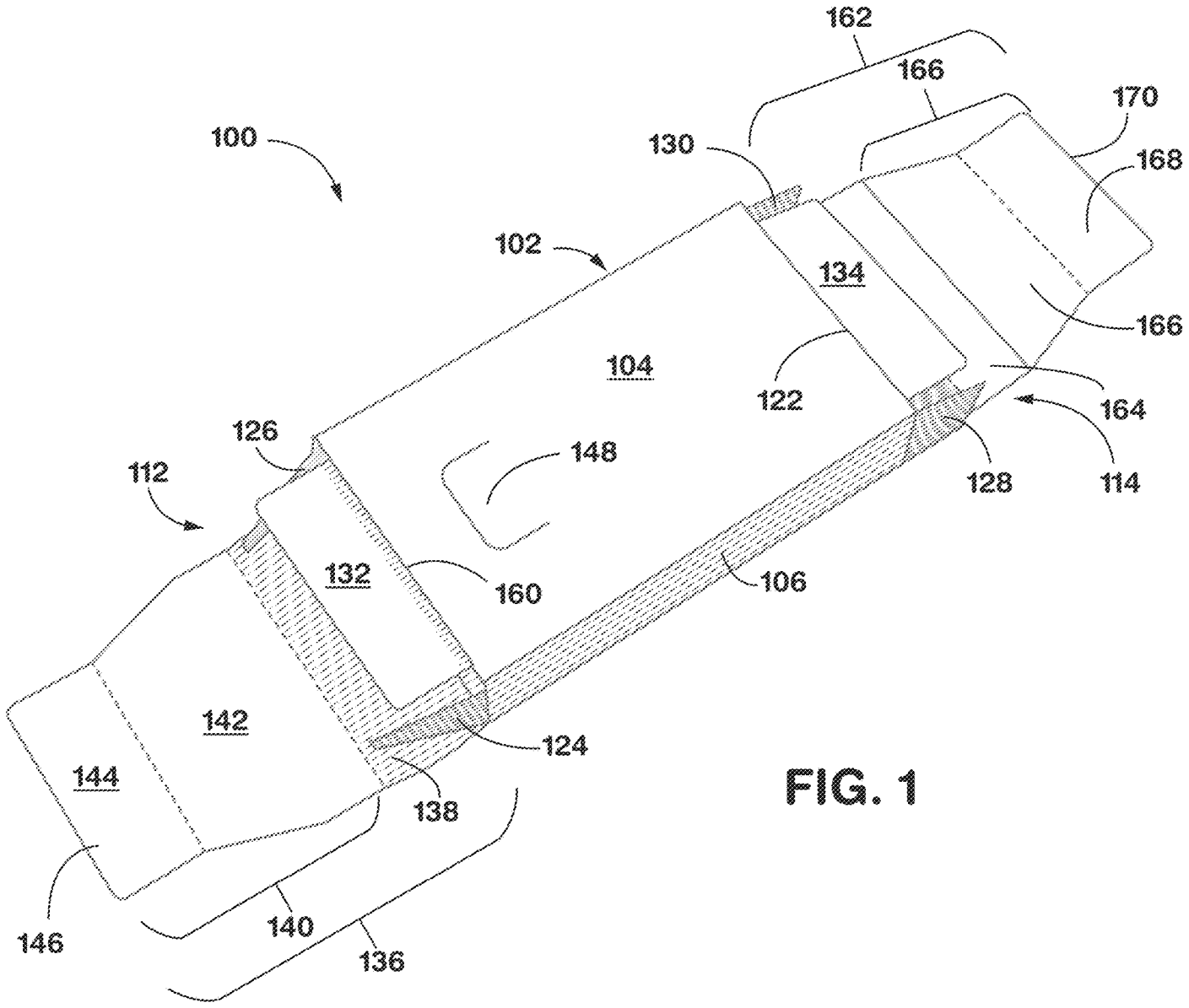
FIG. 1 is an image showing a perspective view of an example of a child resistant paperboard package in which two ends of the package are open.

FIGS. 1 to 7 show images of an example of a recyclable child resistant package 100. FIG. 1 is a perspective view of the recyclable child resistant package 100 that is partially assembled in which two ends of the package 100 are open. In some implementations, the child resistant package 100 includes an outer cell 102 having a first side panel 104, a second side panel 106, a third side panel 108 (which is opposite to the first side panel 104, see FIG. 6), and a fourth side panel 110 (which is opposite to the second side panel 106, see FIG. 7) that define a partial enclosure having a first opening 112 and a second opening 114.

An inner cell 116 (obscured from view in the figure) includes a fifth panel 150 (see FIG. 3) that is spaced apart from the first side panel 104 by a small predetermined distance (e.g., about 1/32 to 1/16 of an inch). The inner cell 116 divides the partial enclosure into a first chamber 152 and a second chamber 154 (see FIGS. 3 and 7). The first chamber 152 is between the third side panel 108 and the fifth panel 150, and the second chamber 154 is between the first side panel 104 and the fifth panel 150. The first chamber 152 is the main chamber of the package 100 and is used for holding items (e.g., medicine) to be contained in the package. In some examples, the inner cell 116 includes a sixth panel 156 and a seventh panel 158 (see FIG. 6), in which the sixth panel 156 is attached to an inner side of the second side panel 106, and the seventh panel 158 is attached to an inner side of the fourth side panel 110, thereby allowing the fifth panel 150 to maintain the predetermined distance from the first side panel 104.

In some implementations, a first inner locking tab 118 (see FIG. 7) is coupled to a first end 160 of the first side panel 104, folded inwards, and attached to an inner wall of the first side panel 104. The first inner locking tab 118 has an edge 119 (obscured from view in the figure) that faces towards the second opening 114. A second inner locking tab 120 (obscured from view in the figure) is coupled to a second end 122 of the first side panel 104, folded inwards, and attached to an inner wall of the first side panel 104. The second inner locking tab 120 has an edge 121 (obscured from view in the figure) that faces towards the first opening 112.

In some implementations, a first end flap 124 is coupled to a first end of the second side panel 106, and a second end flap 126 is coupled to a first end of the fourth side panel 110. A third end flap 128 is coupled to a second end of the second side panel 106, and a fourth end flap 130 is coupled to a second end of the fourth side panel 110. A first cover panel 132 is coupled to a first end of the fifth panel 150, and a second cover panel 134 is coupled to a second end of the fifth panel 150.

In some implementations, a first extension panel 136 is coupled to a first end of the third side panel 108. The first extension panel 136 includes a third cover panel 138 and a first tuck flap 140. The first opening 112 can be closed and locked using the following steps. The first cover panel 132, the first end flap 124, the second end flap 126, and the third cover panel 138 are folded inward to cover the first opening 112. The first tuck flap 140 is inserted into the second chamber 154 between the first side panel 104 and the fifth panel 150 (see FIGS. 3 and 4).

The first tuck flap 140 includes an extension 142 and a first tuck flap locking tab 144 that has an edge 146. The first tuck flap locking tab 144 is folded back (see FIGS. 2 to 4) such that when the first tuck flap 140 is fully inserted into the second chamber 154 (see FIG. 5), the edge 146 faces the first opening 112. The length of the extension 142 is designed such that the edge 146 of the first tuck flap locking tab 144 engages the edge 119 of the first inner locking tab 118. The fifth panel 150 biases extension 142 and the first tuck flap locking tab 144 toward the first side panel 104, which causes the edge 146 of the first tuck flap locking tab 144 to face the edge 119 of the first inner locking tab 118. If a user attempts to open the package 100 by pulling on the third cover panel 138, the edge 146 of the first tuck flap locking tab 144 will bump against the edge 119 of the first inner locking tab 118, preventing the first tuck flap 140 from being pulled out of the second chamber 154, and thereby locking the first extension panel 136.

The distance between the fifth panel 150 and the first inner locking tab 118 is slightly larger than the combined thicknesses of the extension member 142 and the first tuck flap locking tab 144 to allow the extension member 142 and the first tuck flap locking tab 144 to be easily inserted into the second chamber 154.

In some implementations, a release button 148 is provided by forming a cut (e.g., a U-shaped cut) in the first side panel 104. When a user presses down on the button 148, the button 148 pushes down on the first tuck flap locking tab 144 to cause the first tuck flap locking tab 144 to disengage from the first inner locking tab 118. This allows the user to pull the third cover panel 138 and the tuck flap 140 outward to cause the tuck flap 140 to be extracted from the second chamber 154, thereby revealing the first opening 112. Other types of release mechanisms can also be used. For example, the package 100 can have a release member formed by a predefined crease, embossed area, or graphically identified area.

The package 100 is child resistant because the use of the release button 148 (or another type of release mechanism) in combination with pulling the third cover panel 138 and the tuck flap 140 in order to open the package 100 may not be apparent to a child. It may not be apparent to the child the purpose of the cut line on the first side panel 104. At the same time, pressing the release button 148 in combination with pulling the third cover panel 138 and the tuck flap 140 is easy for an adult, hence the package 100 is senior friendly.

In some implementations, a second extension panel 162 is coupled to a second end of the third side panel 108. The second extension panel 162 includes a fourth cover panel 164 and a second tuck flap 166. The second opening 114 can be closed and locked using the following steps. The second cover panel 134, the third end flap 128, the fourth end flap 130, and the fourth cover panel 164 are folded inward to cover the second opening 114. The second tuck flap 166 is inserted into the second chamber 154 between the first side panel 104 and the fifth panel 150.

The second tuck flap 166 includes a second tuck flap locking tab 168 that has an edge 170. The second tuck flap locking tab 168 is folded back (in a manner similar to the first tuck flap locking tab 144) such that when the second tuck flap 166 is fully inserted into the second chamber 154, the edge 170 faces towards the second opening 114. The length of the extension 166 is designed such that the edge 170 of the second tuck flap locking tab 168 engages the edge 121 of the second inner locking tab 120. The fifth panel 150 biases the extension 166 and the second tuck flap locking tab 168 toward the first side panel 104, which causes the edge 170 of the first tuck flap locking tab 144 to face the edge 121 of the second inner locking tab 120. If a user attempts to open the package 100 by pulling on the fourth cover panel 164, the edge 170 of the second tuck flap locking tab 168 will bump against the edge 121 of the second inner locking tab 120, preventing the second tuck flap 166 from being pulled out of the second chamber 154, thereby locking the second extension panel 162 in place.

In the example shown in FIGS. 1 to 5, there is no release button for the second extension panel 162. After the second tuck flap 166 is fully inserted into the second chamber 154, the second extension panel 162 is locked in place, and the second tuck flap 166 cannot be pulled out of the second chamber 154 without significant effort.

Figure 2:
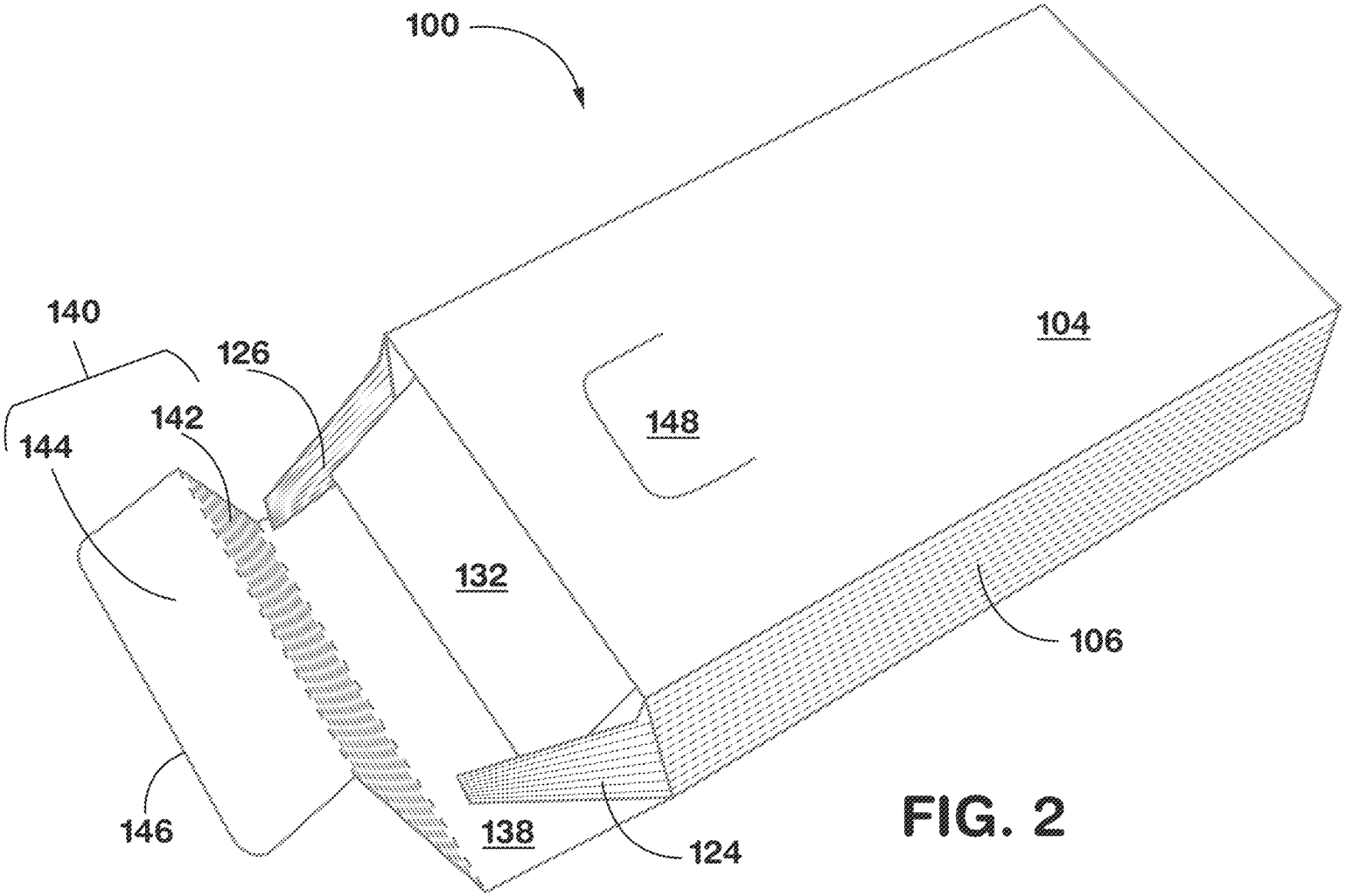
FIGS. 2 and 3 are images showing perspective views of the child resistant paperboard package in which one end of the package is closed.

FIG. 2 is a perspective view of the recyclable child resistant package 100 in which the first opening 112 remain open, and the second opening 114 is closed. The second tuck flap 166 is tucked into and locked inside the second chamber 154.

Figure 3:
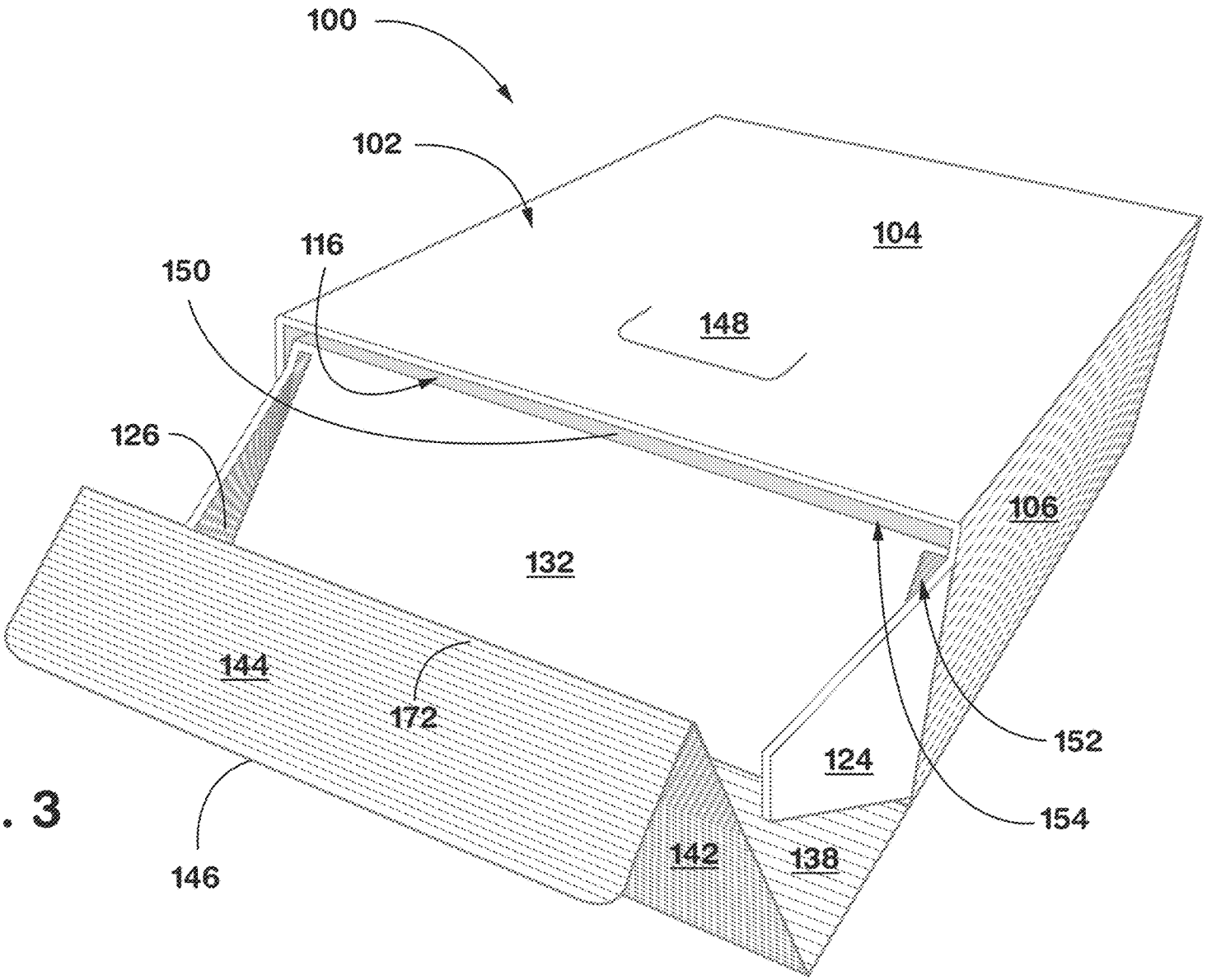

FIG. 3 is a perspective view of the recyclable child resistant package 100 showing the configuration of the first cover panel 132, the first end flap 124, the second end flap 126, the third cover panel 138, the extension 142, and the first tuck flap locking tab 144. The first chamber 152 and the second chamber 154 can be seen in FIG. 3.

A fold 172 between the extension 142 and the first tuck flap locking tab 144 is configured such that the first tuck flap locking tab 144 is at an angle (e.g., between 5 to 175 degrees) in an unbiased or uncompressed state. When the first tuck flap locking tab 144 and the extension 142 are squeezed into the narrow second chamber 154, there is a tendency for the first tuck flap locking tab 144 to flex towards the first side panel 104. In part due to the narrow width of the second chamber 154, the edge 146 of the first tuck flap locking tab 144 is biased against the inner side of the first side panel 104 and engages the edge 119 of the first inner locking tab 118, thereby locking the first extension panel 136 in place.

Figure 4:
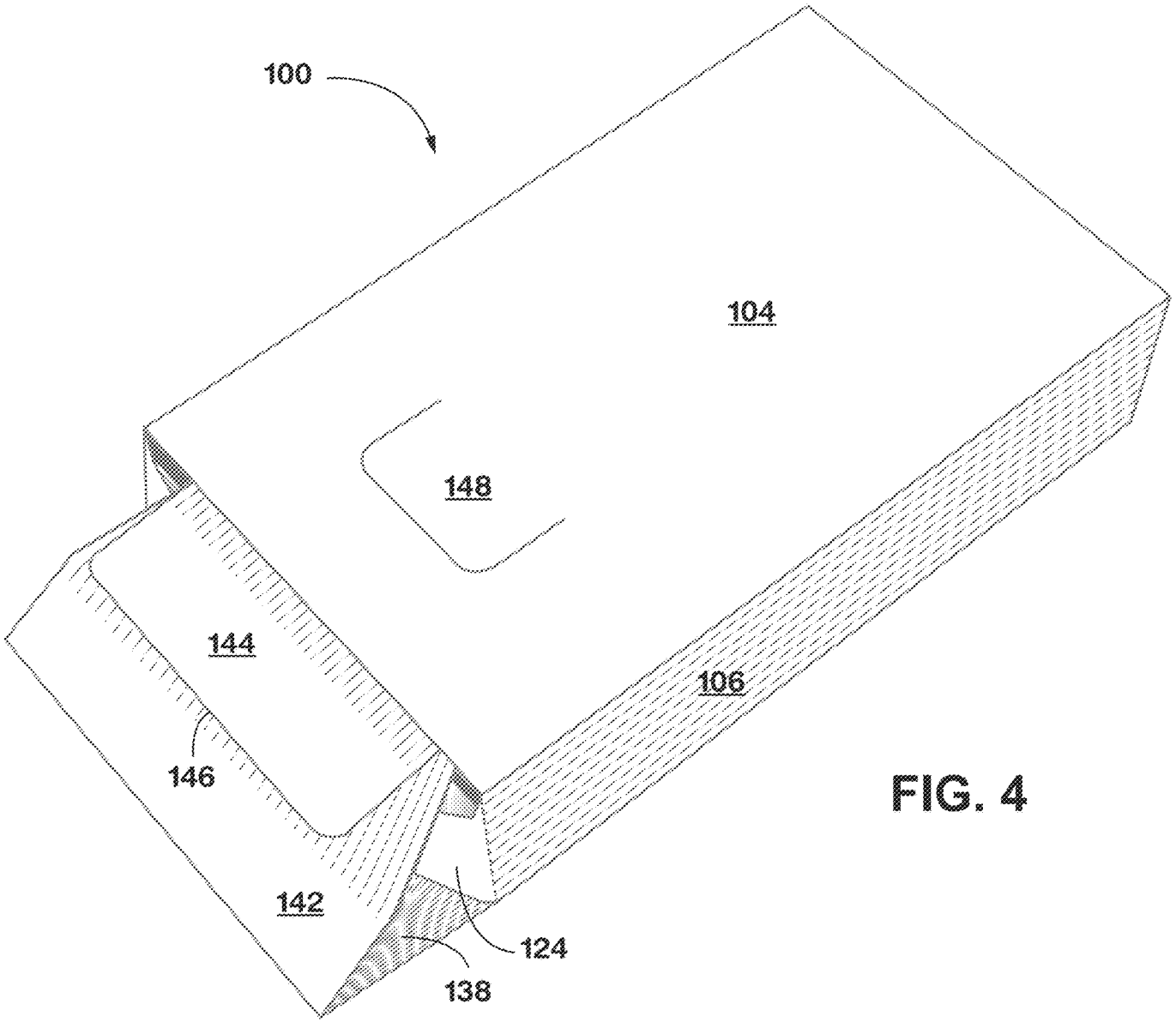
FIG. 4 is an image showing a perspective view of the child resistant paperboard package in which one end of the package is closed, and another end of the package has a tuck flap that is partially inserted into a chamber of the package.

FIG. 4 is a perspective view of the recyclable child resistant package 100 with the extension 142 and the first tuck flap locking tab 144 partly inserted into the second chamber 154.

Figure 5:
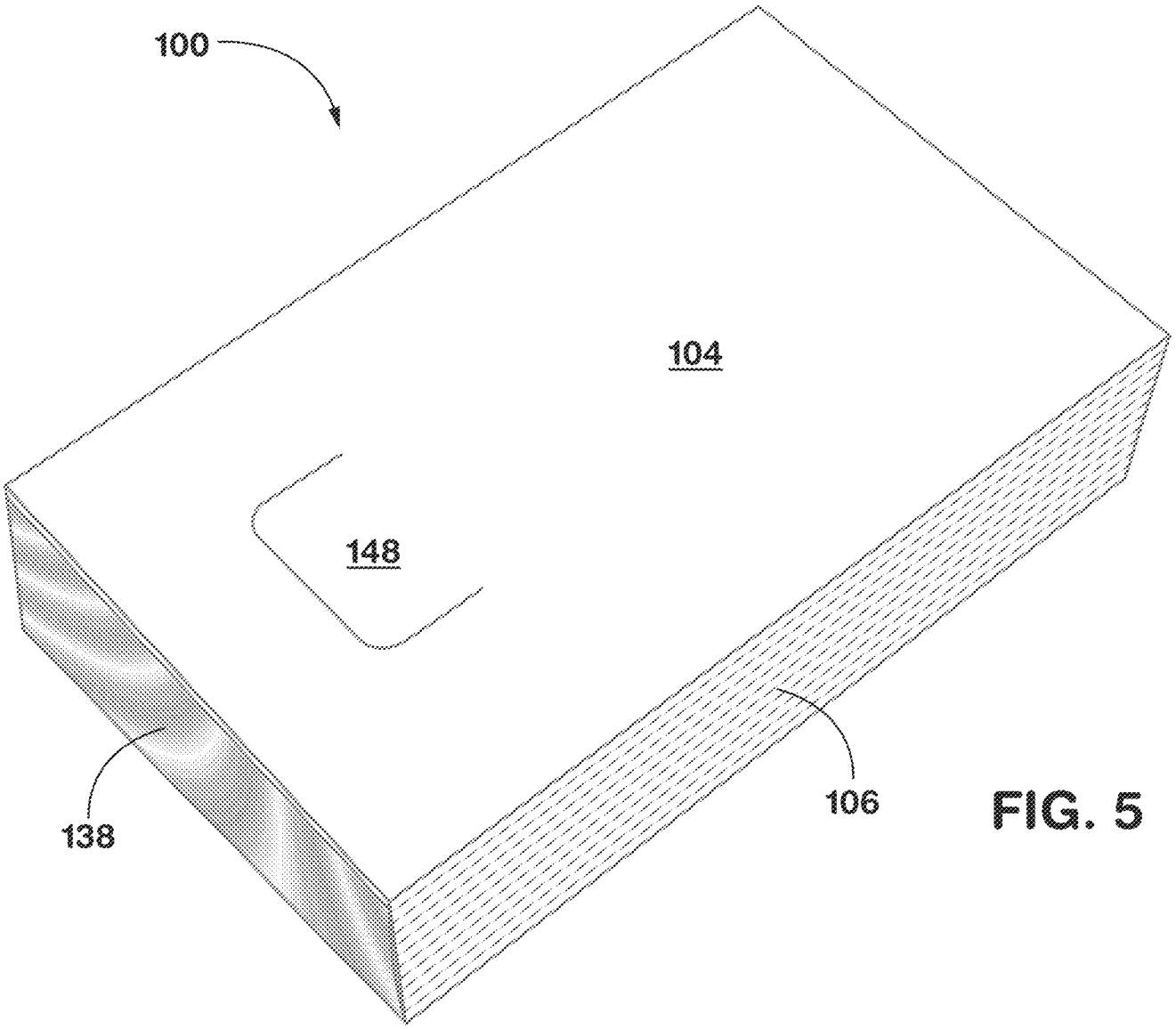
FIG. 5 is an image showing a perspective view of the child resistant paperboard package in which both ends of the package is closed.

FIG. 5 is a perspective view of the recyclable child resistant package 100 with the extension 142 and the first tuck flap locking tab 144 fully inserted into the second chamber 154, closing the first opening 112.

Figure 6:
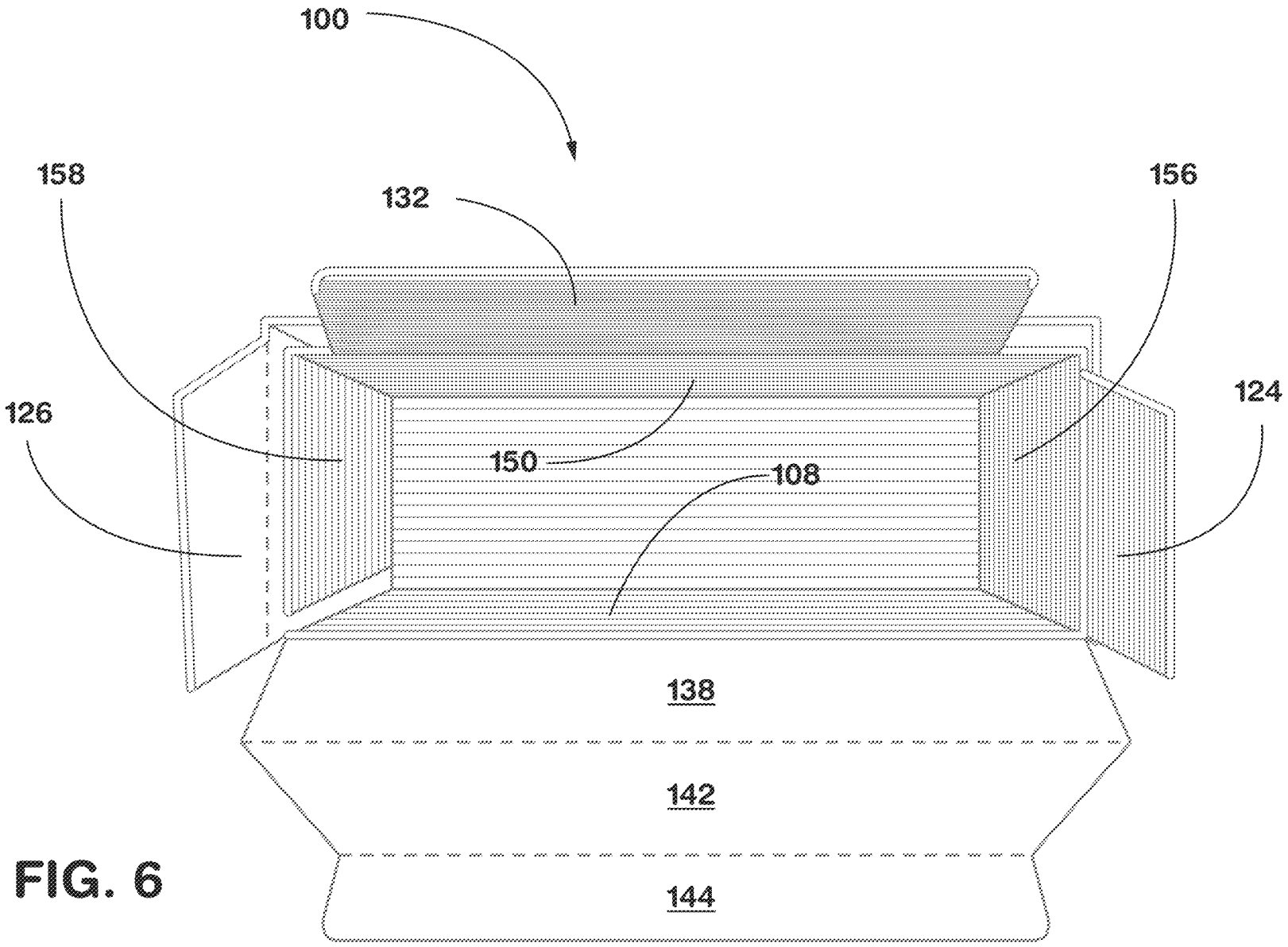
FIG. 6 is an image showing a first child resistant paperboard package placed on a second child resistant paperboard package, in which two ends of the first package are open, and two ends of the second package are closed.

FIG. 6 shows the first recyclable child resistant package 100 of FIG. 1 resting on a second recyclable child resistant package. The figure shows a view looking through the first chamber 152 from the first opening 112 to the second opening 114. As shown in the figure, the sixth panel 156 is attached to the inner side of the second side panel 106, and the seventh panel 158 is attached to the inner side of the fourth side panel 110, thereby allowing the fifth panel 150 to maintain the predetermined distance from the first side panel 104.

Figure 7:
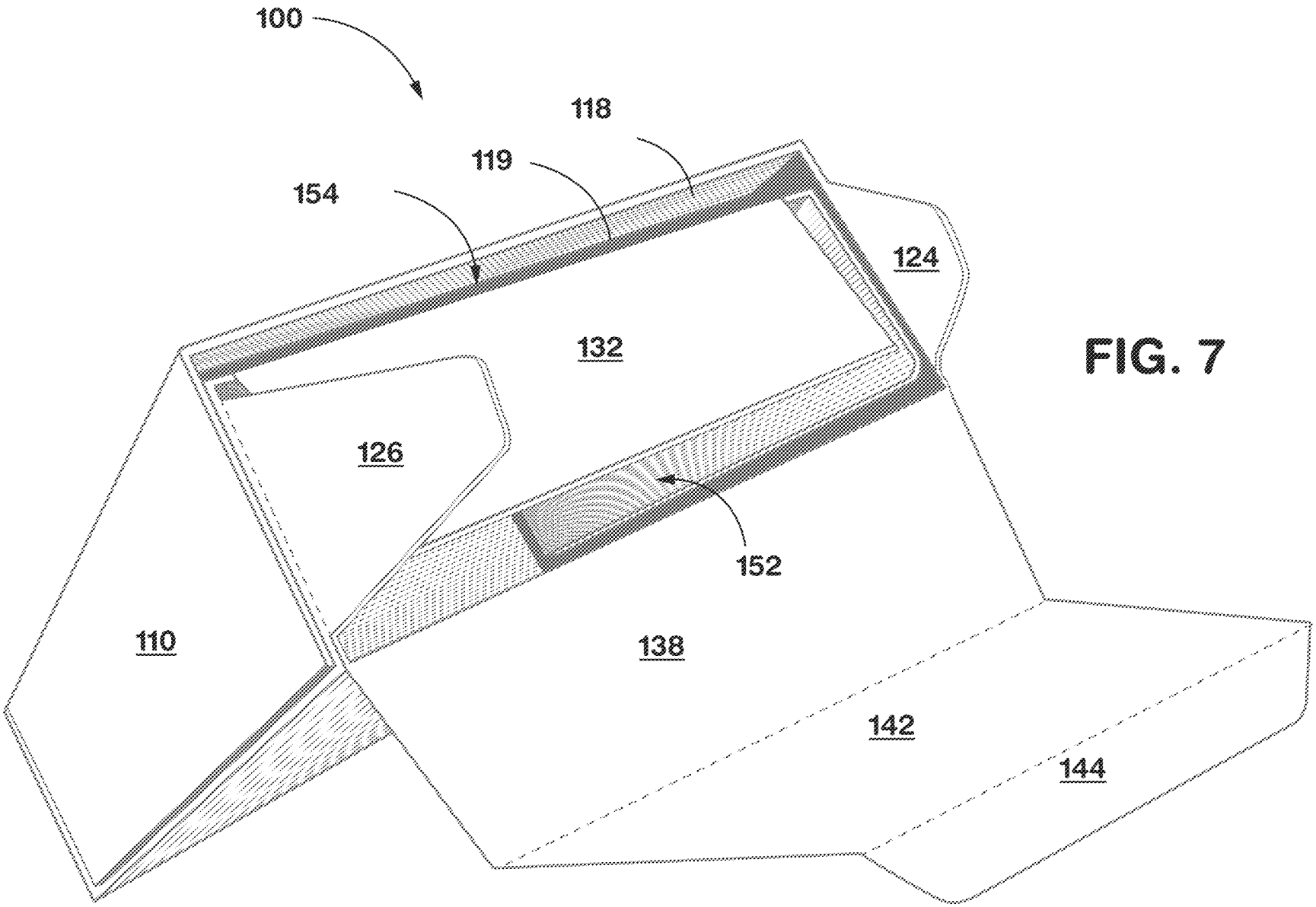
FIG. 7 is an image showing the child resistant paperboard package in which one end of the package is partially open.

FIG. 7 shows the first recyclable child resistant package 100 of FIG. 1, in which the first inner locking tab 118 and the edge 119 can be seen. As shown in the figure, when the first cover panel 132 covers the first opening 112, the second chamber 154 remains open and can receive the first tuck flap 140.

In some implementations, the recyclable child resistant package 100 can be made from a continuous sheet of material, such as a paperboard, a cardboard, or a sheet of paper pulp. For example, the fourth side panel 110 can be connected to the first side panel 104, which can be connected to the second side panel 106, which can be connected to the third side panel 108, which can be connected to the seventh panel 158, which can be connected to the fifth panel 150, which can be connected to the sixth panel 156. In this example, the inner sleeve and the outer sleeve of the package 100 are made of a continuous sheet of paperboard.

In some implementations, a second release button is provided to enable the user to pull the second tuck flap 166 from the second chamber 154. The second release button can have a configuration similar to, and can operate similar to, the first release button 148.

Figure 8A:
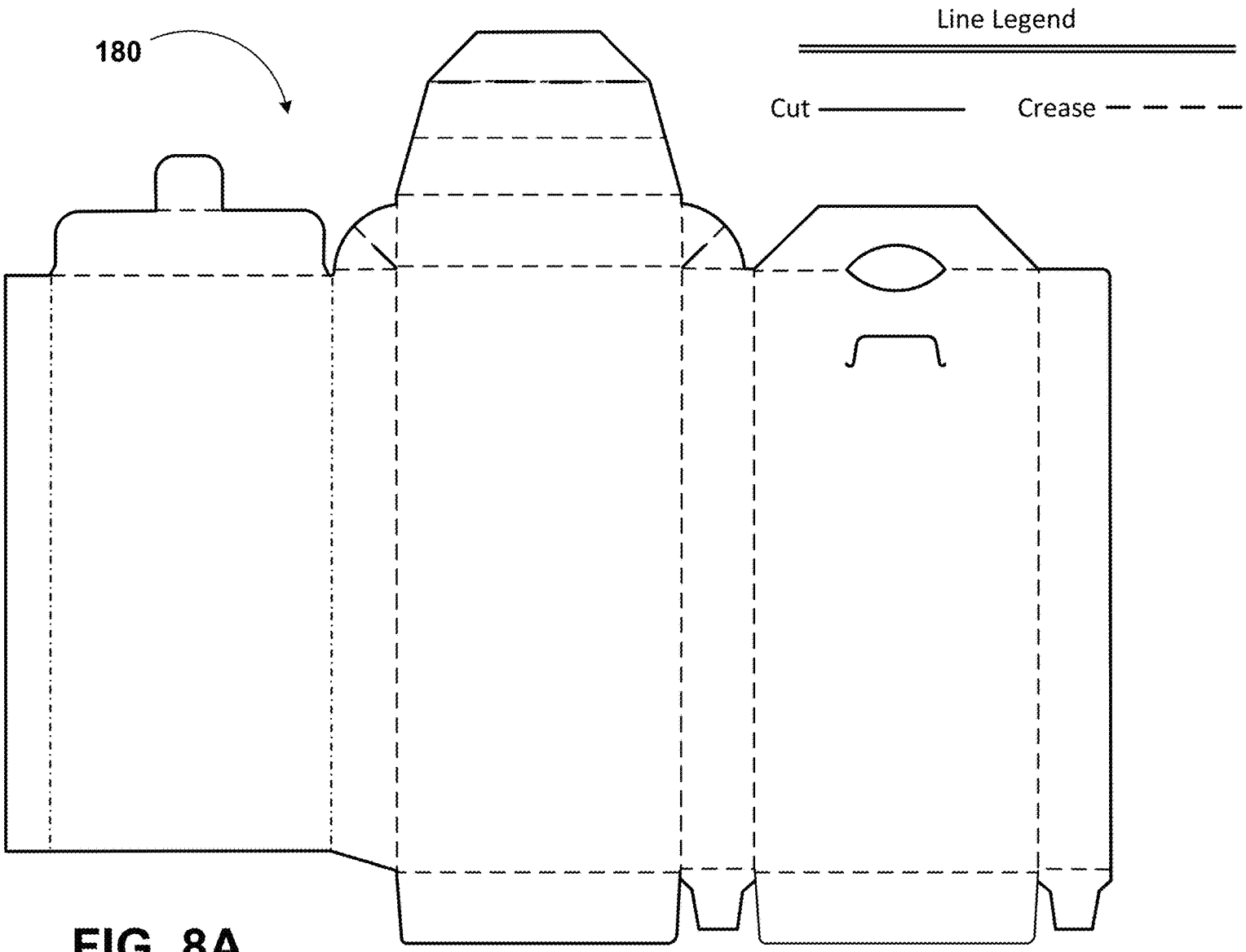
FIGS. 8A and 8B are diagrams of an example of a layout for a child resistant paperboard package.
Figure 8B:
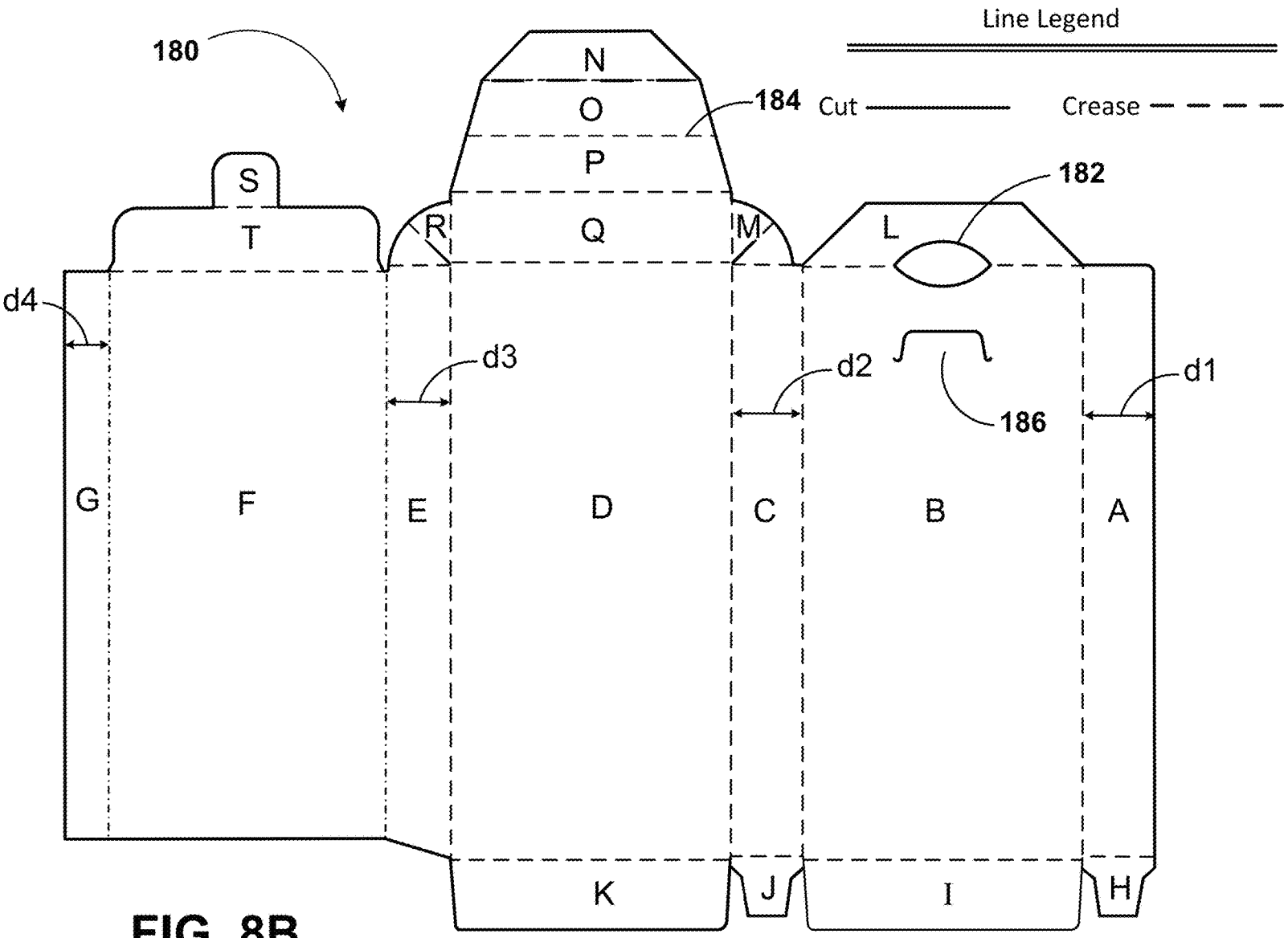

FIGS. 8A and 8B show the layout of the paperboard for a child resistant package 180 that is a variation of the package 100 of FIG. 1. The package 180 has a first end having an opening and a cover with a child resistant locking feature (similar to the package 100), and a second end having flaps that are glued together to form a sealed end.

The package 180 uses web corners instead of the dust-flaps 124 and 126 of the package 100. The web corners add strength and make it more difficult for children to open the package 180.

In FIG. 8B, different parts of the paperboard have been labeled from "A" to "T." The portions A, B, C, and D form the sidewalls of the outer cell of the package 180 (similar to the outer cell 102 of the package 100), and the portions E, F, and G form the sidewalls of the inner cell of the package 180 (similar to the inner cell 116 of the package 100). The portions A, B, C, D, E, F, and G of the package 180 are similar to the panels 110, 104, 106, 108, 158, 150, and 156, respectively, of the package 100. During assembly of the package 180, the portion E is attached (e.g., glued or taped) to the inner wall of the portion A, and the portion G is attached (e.g., glued or taped) to the inner wall of the portion C.

The widths d1 and d2 of the portions A and C, respectively, define the height of the package 180. In this example, d1 is equal to d2 so that the outer shape of the package 180 resembles a rectangular box. The portion E has a width d3 that is slightly smaller than d1. The portion G has a width d4 that is slightly smaller than d2.

The portions E, F, and G of the package 180 define a first chamber, which is similar to the first chamber 152 of the package 100. The portions B and F, and a fraction of the portions A and C of the package 180 define a second chamber, which is similar to the second chamber 154 of the package 100.

The portions H and J of the package 180 are similar to the flaps 130 and 128, respectively, of the package 100. The portion I can be glued to the portion K to seal the second end of the package 180.

The portion L of the package 180 is similar to the inner locking tab 118 of the package 100. During assembly of the package 180, the portion L is folded inwards and glued to the inner wall of the portion B.

The portions M and R of the package 180 form web corners and function similar to the end flaps 124 and 126, respectively, of the package 100. The portion Q of the package 180 is similar to the cover panel 138 of the package 100.

The portions O and P of the package 180 are similar to the extension 142 of the package 100. The portion N of the package 180 is similar to the tuck flap locking tab 144 of the package 100. A crease 184 is provided between the portions O and P to make it easier to tuck the portions O, P, and N into the second chamber of the package 180.

The portion T of the package 180 is similar to the cover panel 132 of the package 100. The portion S functions as a pull tab that makes it easier for the user to open the cover panel formed by the portion T. In this example, a cutout 182 is provided to form a notch at the first end of the portion B to make it easier for the user to pull the portion P out of the second chamber of the package 180.

In this example, the width d4 of the portion G is slightly smaller than the width d3 of the portion E so that the second chamber has one side that is slightly narrower than the other side. Making a first side (the side closer to the portion A) of the second chamber narrower ensures that the tuck flap locking tab formed by the portion N will engage the inner locking tab formed by the portion L when the package 180 is in the closed state. Making a second side (the side closer to the portion C) of the second chamber slightly taller makes it easier for the user to pull the tuck flap formed by the portions N, O, and P out of the second chamber.

The package 180 includes a release button 186 that is provided by forming a U-shaped cut in the portion B. The release button 186 in the package 180 functions in a similar manner as the release button 148 in the package 100.

Figure 9:
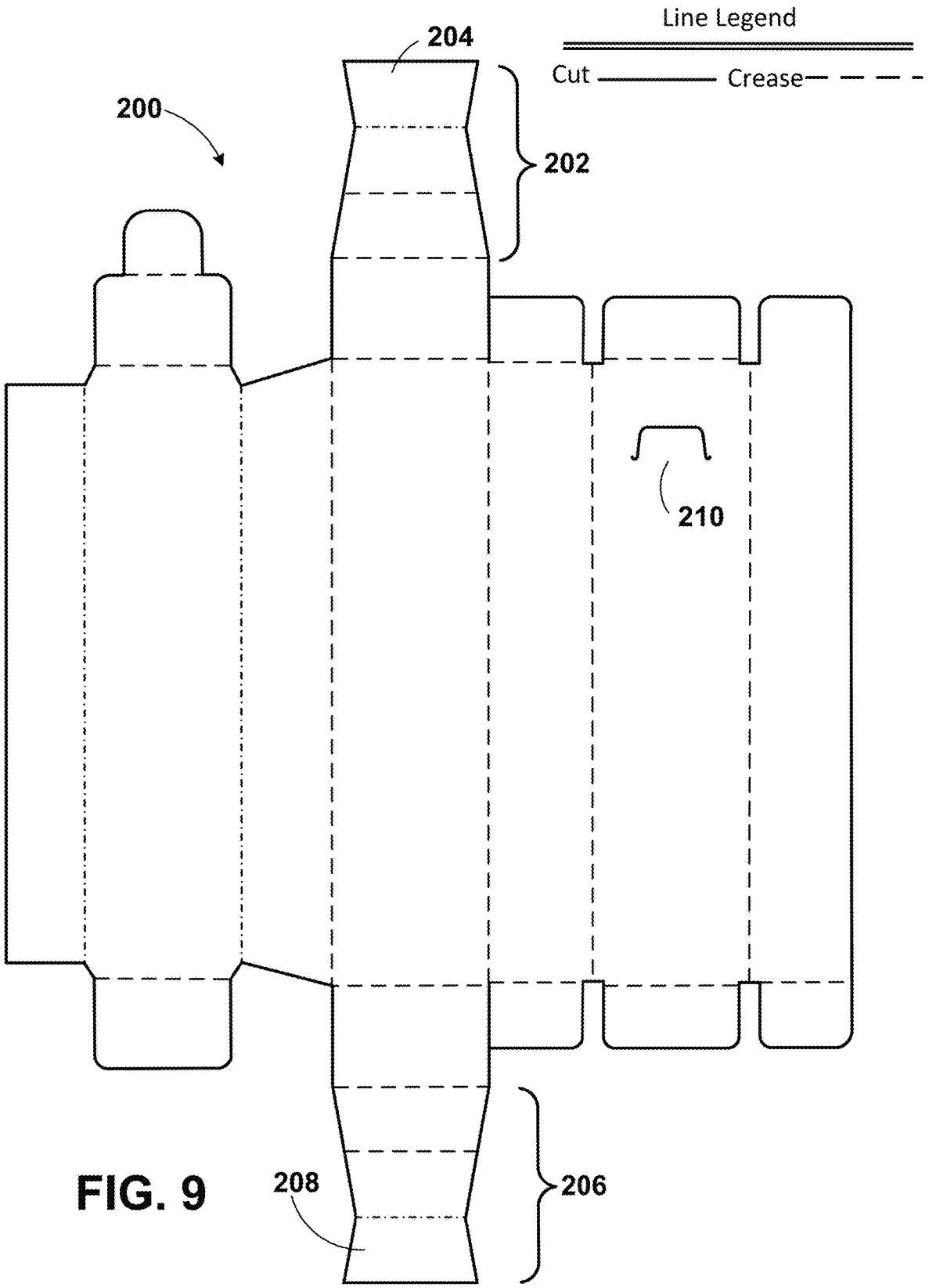
FIG. 9 is a diagram of another example of a layout for a child resistant paperboard package.

FIG. 9 shows the layout of the paperboard for another child resistant package 200 that operates in a manner similar to the package 100 of FIG. 1. The package 200 includes a first tuck flap 202 having a tuck flap locking member 204 at a first end, and a second tuck flap 206 having a tuck flap locking member 208 at a second end. A release button 210 is provided at the first end of the package 200. The package 200 includes a first chamber and a second chamber, similar to those of the package 100. After the first tuck flap 202 is fully inserted into the second chamber of the package 200, the user can press the release button 210 and pull the first tuck flap 202 out of the second chamber. The second end of the package 200 does not have a release button. Thus, after the second tuck flap 206 is fully inserted into the second chamber of the package 200, the second tuck flap 206 is locked in place and cannot be pulled out of the second chamber without significant effort.

The following describes another example of a child resistant, senior friendly package, container, or box that includes an outer sleeve or package and an inner sleeve or container. The inner sleeve or container includes a protruding locking tab that nests into a compatible recess on the outer sleeve or package such that they effectively form a locking mechanism preventing further extraction of the inner sleeve or container from the outer sleeve or package, thereby preventing access to the potentially hazardous contents of the inner sleeve or container by children or others who should not have access to the hazardous contents.

The engaged locking mechanism can be disengaged by depressing a specified location on the outer sleeve or package, which will disengage the inner protruding tab on the inner sleeve or container from the compatible recess on the outer sleeve or package, effectively unlocking the locking mechanism, allowing the inner sleeve or container to be slid open from the outer sleeve or package. One end of the outer sleeve or package is tightly sealed such that the inner sleeve or container can only be opened in one direction to access the potentially hazardous contents. Further embodiments may include multiple locking mechanisms on the inner sleeve or container, on the two sides for example, and additional locking mechanisms may prevent the inner sleeve or container from being completely removed from the outer sleeve or package.

Other embodiments are within the scope of the following claims. For example, in some implementations, a child resistant package can be made of various types of materials, including paperboards, cardboards, plastic boards, metal boards, paper pulp, or a combination of the above. For example, the outer sleeve and the inner sleeve can be made of different sheets of the same material, or different materials. The child resistant package can have any one of various cross-sectional shapes that resemble, e.g., a rectangle, a square, a diamond, a trapezoid, a triangle, a pentagon, a hexagon, or an n-sided polygon with n being greater than 3.

What is claimed is:

1. An apparatus comprising:

a container that is configured to have an open state and a closed state, the container comprising:

an outer cell including a plurality of side panels including a first side panel and a second side panel, in which the second side panel is spaced apart from the first side panel, and the outer cell defines a chamber having a first opening;

an inner locking member attached to an inner wall of the first side panel;

an extension panel coupled to the second side panel, in which the extension panel includes a first cover panel and a tuck flap, and the tuck flap includes an extension member and a tuck flap locking member, wherein in the closed state of the container, the first cover panel is configured to cover the first opening, and the extension member and the tuck flap locking member are tucked inside the chamber; and a bias member configured to bias the tuck flap locking member toward a first position to cause the tuck flap locking member to engage the inner locking member;

wherein the first side panel is parallel to the second side panel, and the bias member comprises a bias panel that is parallel to the first and second side panels;

wherein the bias panel is spaced apart from the first side panel at a first distance, the bias panel is spaced apart from the second side panel at a second distance, and the second distance is at least twice the first distance;

wherein the inner locking member comprises an inner locking tab that is coupled to the first side panel, folded inward into the chamber, and attached to the inner wall of the first side panel, and wherein the bias panel is spaced apart from the inner locking tab at a distance that is larger than combined thicknesses of the extension member and the tuck flap locking member.

2. The apparatus of claim 1 in which the container comprises a release member configured to, upon receiving an external force, bias the tuck flap locking member to a second position to cause the tuck flap locking member to disengage from the inner locking member.

3. The apparatus of claim 2 in which the release member is formed by a predefined cut, crease, embossed area or graphically identified area.

4. The apparatus of claim 1 in which the outer cell comprises a rectangular or square cross sectional shape, the outer cell comprises a third side panel and a fourth side panel, the first and second side panels are parallel to each other, and the third and fourth side panels are parallel to each other.

5. The apparatus of claim 4 in which the container comprises an inner cell, the bias member is part of the inner cell, the inner cell comprises a fifth panel and a sixth panel, the fifth panel is attached to an inner side of the third side panel, and the sixth panel is attached to an inner side of the fourth side panel.

6. The apparatus of claim 5 in which the outer cell and the inner cell are made of a continuous sheet of material.

7. The apparatus of claim 5 in which the fourth side panel is connected to a first side of the first side panel, a second side of the first side panel is connected to a first side of the third side panel, a second side of the third side panel is connected to a first side of the second side panel, a second side of the second side panel is connected to a first side of the sixth panel, a second side of the sixth panel is connected to a first side of the bias member, and a second side of the bias member is connected to the fifth panel.

8. The apparatus of claim 1 in which the inner locking member and the first side panel are made of a continuous sheet of material, and the extension panel and the second side panel are made of a continuous sheet of material.

9. The apparatus of claim 1 in which the bias member comprises a panel that divides the chamber into a first sub-chamber and a second sub-chamber, the first sub-chamber is configured to receive an object to be stored in the container, the second sub-chamber is configured to receive the extension member and the tuck flap locking member when the container is in the closed state.

10. The apparatus of claim 1 in which the first cover panel, the extension member, and the tuck flap locking member are formed by an outer triple fold.

11. The apparatus of claim 1 in which the container comprises an inner sleeve, the bias member is part of the inner sleeve, and the outer sleeve and the inner sleeve are formed using a continuous sheet of material.

12. The apparatus of claim 1 in which the container comprises a second cover panel that is coupled to the inner sleeve, and both the first cover panel and the second cover panel cover the first opening when the container is in the closed state.

13. An apparatus comprising:

a container comprising:

side panels defining a chamber having an opening;

an extension panel that includes a first cover panel and a tuck flap, in which the tuck flap includes an extension member and a tuck flap locking member, wherein the first cover panel, the extension member, and the tuck flap locking member are formed by an outer triple fold, wherein in a closed state of the container, the first cover panel is configured to cover the first opening, and the extension member and the tuck flap locking member are tucked inside the chamber;

a bias member configured to bias the tuck flap locking member toward a first position when the container is in the closed state; and an inner locking member positioned inside the chamber and configured to engage the tuck flap locking member when the tuck flap locking member is in the first position;

wherein the bias member is spaced apart from the inner locking member at a distance that is larger than combined thicknesses of the extension member and the tuck flap locking member.

14. The apparatus of claim 13 in which the container comprises a release member configured to, upon receiving an external force, bias the tuck flap locking member to a second position to cause the tuck flap locking member to disengage from the inner locking member.

15. An apparatus comprising:

a container comprising:

an outer cell comprising a first side panel, a second side panel, a third side panel, and a fourth side panel, in which the first side panel is connected to a first side of the second side panel, a second side of the second side panel is connected to a first side of the third side panel, a second side of the third side panel is connected to a first side of the fourth side panel, wherein the outer cell defines a chamber having a first opening;

an inner cell comprising a fifth panel, a sixth panel, and a seventh panel, in which a second side of the fourth side panel is connected to a first side of the fifth panel, a second side of the fifth panel is connected to a first side of the sixth panel, a second side of the sixth panel is connected to a first side of the seventh panel, wherein the fifth panel is attached to an inner side of the first side panel, the seventh panel is attached to an inner side of the third side panel, and the sixth panel is spaced apart from the second side panel and the fourth side panel, wherein the fourth side panel, the fifth panel, the sixth panel, and the seventh panel define a first chamber, and wherein the second side panel and the sixth panel define a second chamber;

an inner locking member disposed in the second chamber; and an extension panel coupled to the fourth side panel, in which the extension panel includes a first cover panel and a tuck flap, and the tuck flap includes an extension member and a tuck flap locking member, wherein in a closed state of the container, the first cover panel is configured to cover the first opening, the extension member and the tuck flap locking member are tucked inside the second chamber, and the sixth panel is configured to bias the tuck flap locking member to a first position to engage the inner locking member;

wherein the bias panel is spaced apart from the inner locking member at a distance that is larger than combined thicknesses of the extension member and the tuck flap locking member.

16. The apparatus of claim 15 in which the container comprises a release member configured to, upon receiving an external force, bias the tuck flap locking member to a second position to cause the tuck flap locking member to disengage from the inner locking member.

17. An apparatus comprising:

a container having a cover panel and a tuck flap formed by an outer triple fold, in which in a closed state of the container, the cover panel is configured to cover an opening of the container, and the tuck flap is configured to be inserted into a chamber of the container and engage an inner locking member;

wherein the tuck flap includes an extension member and a tuck flap locking member; and wherein the container comprises a side panel and a bias panel, the bias panel is spaced apart from the side panel at a first distance, in which in the closed state of the container, the tuck flap is configured to be inserted into a space between the bias panel and the side panel to engage the inner locking member, and the first distance is larger than combined thicknesses of the extension member and the tuck flap locking member.

18. The apparatus of claim 17, comprising a release member configured to, upon receiving an external force, bias the tuck flap to disengage from the inner locking member.

19. The apparatus of claim 17 in which the container comprises a folded board.

20. The apparatus of claim 19 in which the container comprises a folded paperboard or cardboard.

21. The apparatus of claim 20 in which the container comprises a lining on the paperboard to form a moisture or oil barrier.

22. The apparatus of claim 21 in which the lining comprises at least one of polyresin or bioresin.

* * * * *